US007137151B2

(12) United States Patent
Keech

(10) Patent No.: US 7,137,151 B2
(45) Date of Patent: Nov. 21, 2006

(54) WRITING IMPLEMENT HOLDER

(76) Inventor: Steve Keech, 154 Buttles Ave., Columbus, OH (US) 43215

( * ) Notice: Subject to any disclaimer, the term of this patent is extended or adjusted under 35 U.S.C. 154(b) by 0 days.

(21) Appl. No.: 10/973,554

(22) Filed: Oct. 26, 2004

(65) Prior Publication Data

US 2006/0086879 A1 Apr. 27, 2006

(51) Int. Cl.
*A42B 1/06* (2006.01)

(52) U.S. Cl. ..... 2/209.13; 2/244; 24/10 R; 24/11 PP; 248/316.7

(58) Field of Classification Search ..... 248/316.7; 24/10 R, 11 R, 11 FE; 2/209.13, 244
See application file for complete search history.

(56) References Cited

U.S. PATENT DOCUMENTS 3,983,602 A * 10/1976 Barry ..... 24/11 R
5,573,167 A * 11/1996 Bebb et al. ..... 224/666
5,867,874 A * 2/1999 Simpson ..... 24/336
6,792,619 B1 * 9/2004 Morris et al. ..... 2/10
D503,430 S * 3/2005 Chang ..... D19/83
6,874,167 B1 * 4/2005 Leszczynski ..... 2/209.13
7,018,037 B1 * 3/2006 Jouver, III ..... 351/121
2004/0237262 A1 * 12/2004 Arnone ..... 24/10 R
2005/0074269 A1 * 4/2005 Asselin ..... 401/131
2005/0268378 A1 * 12/2005 Buller ..... 2/209.13

* cited by examiner

*Primary Examiner*—Amy J. Sterling
(74) *Attorney, Agent, or Firm*—Phillips Lytle LLP

(57) ABSTRACT

An improved writing implement holder adapted to be removably attached to headwear having a headband. The writing implement holder has an attaching member connected to a holding member to form a channel for holding a writing implement. The attaching member has a hook portion adapted for insertion into the headband of headwear, thereby removably securing the device to the headwear.

8 Claims, 1 Drawing Sheet

WRITING IMPLEMENT HOLDER

TECHNICAL FIELD

The present invention relates generally to writing implement holders, and more particularly, to a writing implement holder adapted to removably attach to headwear such as an athletic cap.

BACKGROUND OF THE INVENTION

Devices which hold writing implements such as pencils and pens have existed for many years. For example, U.S. Pat. No. 803,464 (Beck) discloses a pencil holder and bookmark combination. U.S. Pat. No. 1,481,984 (Carnett) discloses a pencil holder designed to attach to the cover of a book. U.S. Pat. No. 3,983,602 (Barry) discloses a writing implement holder designed to attach to a safety helmet. U.S. Pat. No. 5,066,154 (Renaud) discloses a writing implement holder designed to attach to a security hat. Other patents, such as U.S. Pat. No. 5,829,103 (Allen) and U.S. Pat. No. 5,867,874 (Simpson) disclose a writing implement holder designed to attach to a hat.

None of the foregoing patents utilizes the apparatus of the present invention, which has significant advantages, as described below. Furthermore, no prior art pencil holder provides a hook portion adapted for insertion into the headband of a cap to secure the holder to the cap. While some prior art pencil holders attach specifically to headwear, such holders may be unreliable, unsecure or uncomfortable. The number and complexity of parts or elements of the prior art also makes manufacturing such devices costly. There is a need, therefore, for a reliable, comfortable writing implement holder that may be efficiently and inexpensively manufactured to securely hold a writing implement and allow for its easy retrieval.

BRIEF SUMMARY OF THE INVENTION

With parenthetical reference to the corresponding parts, portions or surfaces of the disclosed embodiment, merely for purposes of illustration and not by way of limitation, the present invention provides an improved holder for a writing implement such as a pencil, pen or marker. In one aspect of the invention, the writing implement holder (10) is adapted to be removably attached to headwear (8) having a headband (7), such as an athletic cap, and comprises the following elements: an attaching member (2) having a hook portion (3) adapted for insertion into the headband (7) of headwear (8), and a holding member (1), where the attaching member is connected to the holding member, forming a channel (5) for holding a writing implement (6).

Other aspects of the invention include a writing implement holder where the attaching member and the holding member are generally rectangular in shape. In other aspects, the holding member and the attaching member are substantially planar. In other aspects of the invention, the channel formed by the holding member and the attaching member is a U-shaped channel (5). The invention may include indicia (4) inscribed, affixed or attached on the outer surface of the holding member. As used herein, inscription includes without limitation printing, attaching, affixing, engraving, and marking. Such indicia may include writing, art, advertising, logo(s), picture(s), decoration(s), or other ornamentation. Other aspects of the invention include a writing implement holder manufactured as a one-piece unit. The invention may be manufactured from plastic, wood, metal, or any other material known to those skilled in the art.

The general object of the invention is to provide an improved writing implement holder that can easily but securely be mounted to a cap and securely hold a writing implement. Another object is to provide a writing implement holder that will continue to securely hold a writing implement when the cap is removed from the head. Another object is to provide a writing implement holder that will allow the user to easily remove the writing implement from the holder and easily return the writing implement to the holder.

Yet another object is to provide a writing implement holder that will easily attach to both the left and right side of the cap, thereby accommodating both left and right handed users. It is a further object of this invention to provide a writing implement holder that will be conducive to the inscription of indicia such as writing, art, advertising, logo(s), pictures(s), decoration(s), or other ornamentation.

Another object is to provide a writing implement holder that can be comfortably worn by the user for extended periods of time.

Another object of this invention is to provide a writing implement holder that can be manufactured cost effectively, and sold at an acceptable price to the general consumer.

DESCRIPTION OF THE PREFERRED EMBODIMENTS

Figure 1:
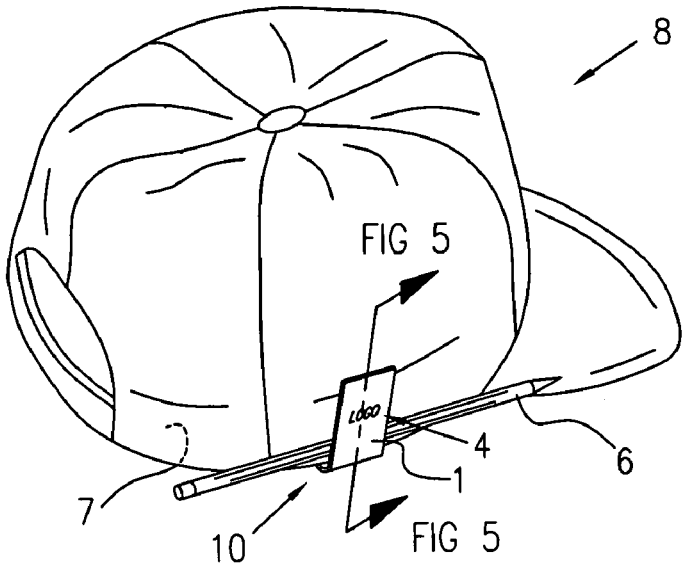
FIG. 1 is a perspective view of a writing implement holder of the present invention attached to an associated cap and holding a pencil for illustration purposes.

At the outset, it should be clearly understood that like reference numerals are intended to identify the same structural elements, portions or surfaces, consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, FIG. 1 illustrates an improved writing implement holder 10 adapted for removable attachment to the headband 7 of a cap 8 or other headwear. In this preferred embodiment, the holder is attached to the baseball cap 8 by insertion of the hook portion 3 into the headband 7. In addition, in this embodiment, a flexible holding member 1 exerts pressure against the cap 8. The combination of attachment of the hook portion and pressure between the holding member and cap retains a pencil 6 between the holding member and a cap. The pencil may be further secured from above by pressure exerted by the hook portion 3 from inside the cap 8. In this preferred embodiment, these three points of contact occur at approximately even intervals around the pencil, thereby providing even pressure to retain the pencil within the U-shaped channel 5 even when the cap is removed from the head.

Figure 2:
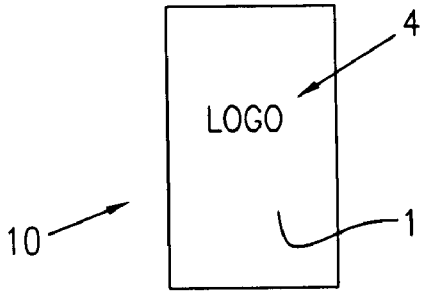
FIG. 2 is a front view of the writing implement holder displaying the outer surface of the holding member with inscribed indicia.

FIG. 2 shows a front view of a preferred embodiment of the writing implement holder as displaying indicia 4 inscribed on the outside surface of the holding member 1. Such indicia may include, but should not be limited to writing, art, advertising, logo(s), decoration(s), picture(s) or other ornamentation.

Figure 3:
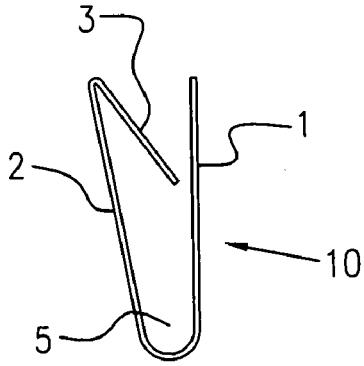
FIG. 3 is a side view of the writing implement holder.
Figure 4:
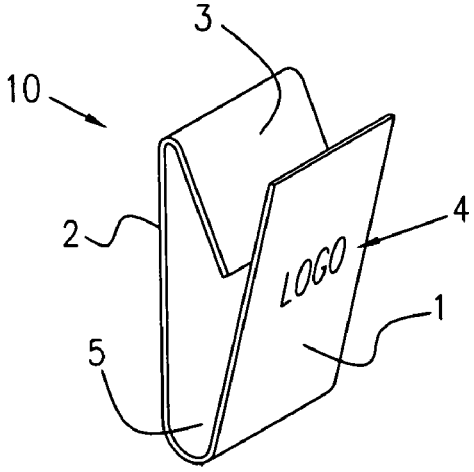
FIG. 4 is a perspective view of the writing implement holder.
Figure 5:
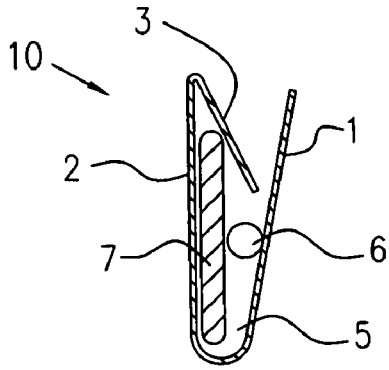
FIG. 5 is a cross-sectional view of the writing implement holder illustrating a cross-sectional view of an associated headband and pencil.

FIGS. 3 and 4 show a preferred embodiment of the writing implement holder as a one-piece unit. This embodiment may be formed of metal, plastic, or wood, or any other material known to those skilled in the art. This preferred embodiment is comprised of a holding member 1 connected to an attaching member 2, forming a U-shaped channel 5 in which to insert a pencil 6 or other writing implement. In this embodiment, the holding member 1 and the attaching member 2 are generally planar and rectangular in shape. The holding member 1 has a hooked end portion 3. The device attaches to a cap, hat, visor, or other headwear having a headband 7 by insertion of the hook portion 3 into or around the headband 7 of the headwear. The holding member 1 is flexible so it exerts pressure against the hook portion 3 to further secure the device to the cap, but can easily retract to accommodate insertion of a pencil or other writing implement into the channel 5.

While there has been described what is believed to be the preferred embodiment of the present invention, those skilled in the art will recognize that other and further changes and modifications may be made thereto without departing from the spirit of the invention. Therefore, the invention is not limited to the specific details and representative embodiments shown and described herein. Accordingly, persons skilled in this art will readily appreciate that various additional changes and modifications may be made without departing from the spirit or scope of the invention, as defined and differentiated by the following claims. In addition, the terminology and phraseology used herein is for purposes of description and should not be regarded as limiting.

What is claimed is:

1. A writing implement holder for removable attachment to headwear having a headband and an inner surface, consisting of:

an attaching member having a proximal end portion, a distal end portion and a reversibly inclined hook portion, said hook portion being connected in series to said attaching member at said distal end portion such that said attaching member and said hook portion are arranged to have an acute included angle, and such that said attaching member and said hook portion are so dimensioned and configured to capture said headband between them to secure said writing implement holder to said headwear;

a holding member connected in series to said proximal end portion of said attaching member;

said attaching member and said holding member forming a generally U-shaped channel for holding a writing implement.

2. The writing implement holder of claim 1 wherein said attaching member and said holding member are substantially planar.

3. The writing implement holder of claim 1 wherein said attaching member and said holding member are generally rectangular.

4. The writing implement holder of claim 1 wherein said holding member has an outside surface and said outside surface is inscribed with indicia.

5. The writing implement holder of claim 4 wherein said indicia is writing, art, advertising, logo, decoration, picture or other ornamentation.

6. The writing implement holder of claim 1 wherein said writing implement holder is constructed as a one-piece unit.

7. The writing implement holder of claim 1 wherein said writing implement holder is manufactured from wood, plastic or metal.

8. An athletic cap comprising the writing implement holder of claim 1.

* * * * *